US007326121B2

(12) United States Patent
Roake

(10) Patent No.: US 7,326,121 B2
(45) Date of Patent: Feb. 5, 2008

(54) GOLF PUTTER

(76) Inventor: James P. Roake, 15903 SE. Rivershore Dr., Vancouver, WA (US) 98683

( * ) Notice: Subject to any disclaimer, the term of this patent is extended or adjusted under 35 U.S.C. 154(b) by 225 days.

(21) Appl. No.: 11/197,167

(22) Filed: Aug. 3, 2005

(65) Prior Publication Data

US 2006/0030420 A1 Feb. 9, 2006

Related U.S. Application Data

(60) Provisional application No. 60/598,740, filed on Aug. 3, 2004.

(51) Int. Cl.
*A63B 69/36* (2006.01)
*A63B 53/04* (2006.01)

(52) U.S. Cl. ..... 473/251; 473/252; 473/337; 473/340; 473/341

(58) Field of Classification Search ..... 473/334–339, 473/340–341, 251–254, 238–244; D21/736–746
See application file for complete search history.

(56) References Cited

U.S. PATENT DOCUMENTS 4,741,535 A * 5/1988 Leonhardt ..... 473/252
4,871,174 A * 10/1989 Kobayashi ..... 473/252
5,282,622 A * 2/1994 Evans ..... 473/243
5,409,219 A * 4/1995 Saksun, Sr. ..... 473/305
5,580,058 A * 12/1996 Coughlin ..... 273/250
5,769,736 A * 6/1998 Sato ..... 473/335
5,947,841 A * 9/1999 Silvestro ..... 473/341
5,997,409 A * 12/1999 Mattson ..... 473/244
6,176,791 B1 * 1/2001 Wright ..... 473/252
6,464,599 B1 * 10/2002 Wolf ..... 473/328
6,485,375 B1 * 11/2002 McKinley ..... 473/245
6,692,372 B1 * 2/2004 Colucci ..... 473/251
7,018,304 B2 * 3/2006 Bradford ..... 473/334
7,182,697 B2 * 2/2007 Zamora ..... 473/251
2006/0079343 A1 * 4/2006 Zamora ..... 473/251

* cited by examiner

*Primary Examiner*—Sebastiano Passaniti
(74) *Attorney, Agent, or Firm*—Kolisch Hartwell, P.C.

(57) ABSTRACT

A golf putter system including features that allow customization of the overall weight of the putter head, as well as the distribution of the weight. The golf putter includes a shaft and a head that is attached to an end of the shaft. The head typically includes an elongated body including a front face having a substantially flat putting surface adapted to strike a golf ball on a ball striking area disposed on the putting surface. The system normally includes a plurality of elongated end members that are releasably attachable adjacent each end of the body. The end members, when attached, may allow a user to configure the overall weight of the head and may allow a user to configure the location of the center of mass of the head. The end members generally include a rear portion that, when attached, extends beyond a rear surface of the body, axes that are substantially perpendicular to a longitudinal axis of the putting face when attached, as well as, end sight lines that mark the axes of the end members. When the end members are attached to the head, the end sight lines are typically spaced apart by a width that is similar to the diameter of a golf hole. Other embodiments are herein described.

20 Claims, 3 Drawing Sheets

GOLF PUTTER

CROSS-REFERENCES

This application claims the benefit of U.S. Provisional Application No. 60/598,740, filed Aug. 3, 2004. The contents of that disclosure are incorporated herein by reference in their entirety for all purposes.

FIELD OF THE DISCLOSURE

The present disclosure relates to golf putters that may provide for customization of the weight characteristics of the putting head, as well as multiple sight lines for improved alignment of putting strokes.

BACKGROUND

Up to one half of the strokes taken in a round of golf may be putts. Golfers are continuously looking for a putter that allows for increased customization of the weight profile of the putting head and for improved sight lines for aligning putting strokes. The putter of the present disclosure has been found to provide increased levels of customization of the weight of the putting head and the distribution of the weight, including the location of the center of mass. Moreover, the putter of the present disclosure has been found to provide the golfer with increased sight lines to accurately aim his putting strokes and potentially reduce his score on a round of golf.

SUMMARY

Some embodiments provide a golf putter system including features that allow customization of the overall weight of the putter head, as well as the distribution of the weight. The golf putter includes a shaft and a head that is attached to an end of the shaft. The head typically includes an elongated body including a front face having a substantially flat putting surface adapted to strike a golf ball on a ball striking area disposed on the putting surface. The system normally includes a plurality of elongated end members that are releasably attachable adjacent each end of the body. The end members, when attached, may allow a user to configure the overall weight of the head and may allow a user to configure the location of the center of mass of the head. the end members generally include a rear portion that, when attached, extends beyond a rear surface of the body, axes that are substantially perpendicular to a longitudinal axis of the putting face when attached, as well as, end sight lines that mark the axes of the end members. When the end members are attached to the head, the end sight lines are typically spaced apart by a width that is similar to the diameter of a golf hole.

Some embodiments provide a golf putter including features that allow customization of the overall weight of the putter head, as well as the distribution of the weight. Some embodiments provide a golf putter head including features that allow customization of the overall weight of the putter head, as well as the distribution of the weight. Other embodiments are herein described.

DETAILED DESCRIPTION

Figure 1:
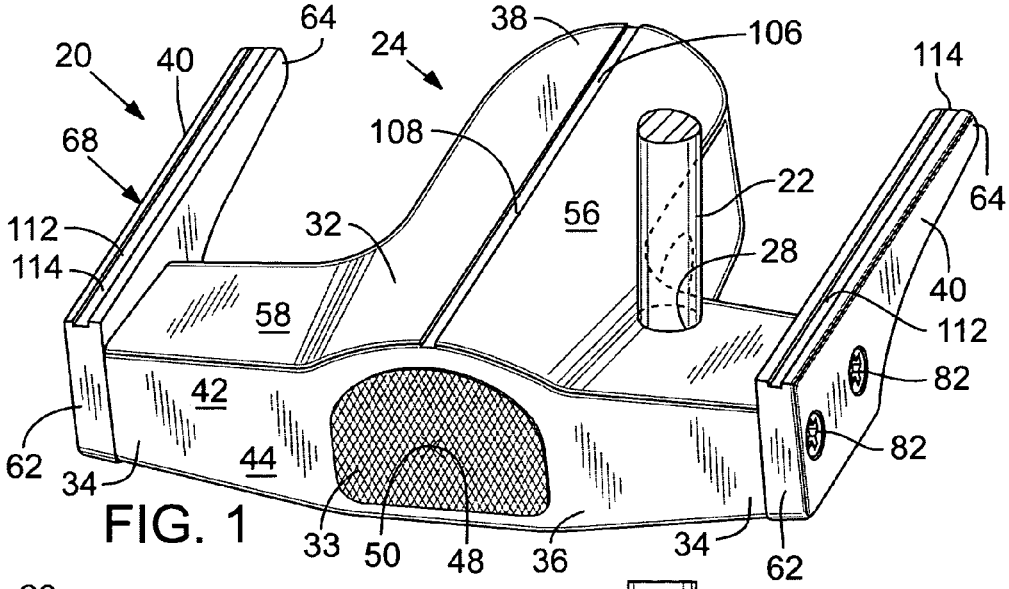
FIG. 1 is an isometric view of a golf putter according to the present disclosure, viewed from the top.

An illustrative example of golf putter that may provide for customization of the weight characteristics of the putting head, as well as multiple sight lines for improved alignment of putting strokes is shown in FIGS. 1-6 and indicated generally at 20. Golf putter 20 typically includes an elongated shaft 22 that is mated to a head 24. Accordingly, head 24 may include one or more holes 26 adapted for the insertion of an end 28 of shaft 22. Head 24 may be fixedly attached to shaft 22 by solder, glue or suitable techniques, or, alternatively, head 24 may be removably attached to shaft 22 by complementary threaded connections or other suitable mechanisms. In use, a golfer generally grasps a top end 30 of shaft 22, aims a stroke using various alignment aids that may be present on head 24, and strikes a golf ball to propel the ball towards, and ultimately into, a hole on a golf course putting green. The weight characteristics of putter head 24 may affect the accuracy of putt executed using putter 20. Different golfers may prefer putter heads 24 of different overall weights. Moreover, golfers may also prefer a putting head 24 that has a center of mass closer to top surface 32, behind ball striking area 33, or towards the ends 34 of an elongated body 36.

Figure 3:
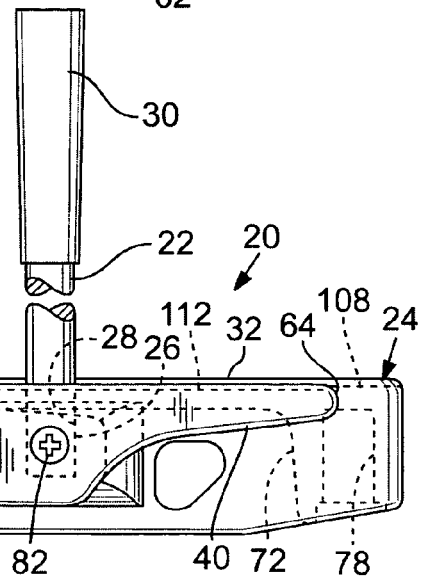
FIG. 3 is a side elevation view of the golf putter of FIG. 1.

Head 24 typically includes body 36, an elongated central member 38, and two elongated end members 40. Body 36 generally includes a front face 42 having a putting surface 44 that has substantially flat and that is adapted to strike a golf ball on a ball striking area 33 that is disposed on putting surface 44, and that typically has a midpoint 48 disposed at a midpoint 50 of putting surface 44. When putter 20 is held in a putting position, putting surface 44 generally forms an angle $\Theta$ of between approximately 0 and 6 degrees with a substantially vertical plane, as shown in FIG. 3.

Central member 38 normally has a central axis 52 that is substantially perpendicular to a longitudinal axis 54 of putting face 44, and generally extends rearward from body 36 in the proximity of ball striking area 33. A top surface 56 of central member 38 may be continuous with, or preferably may extend above a top surface 58 of body 36. Typically, central member 38 has a width that is similar to the diameter of a golf ball.

End members 40 are typically disposed at each end 34 of body 36, and have axes 60 that are substantially perpendicular to the longitudinal axis 54 of putting face 44 and that are substantially parallel to each other and to central axis 52 of central member 38. A front portion 62 of end members 40 may extend beyond front face 42 of body 36. Similarly, a rear portion 64 of end members 40 may extend beyond a rear surface 66 of body 36. A top surface 68 of end member 40 may extend above or below a top surface 58 of body 36, or top surface 68 of end member 40 may be continuous with top surface 58 of body 36.

Figure 2:
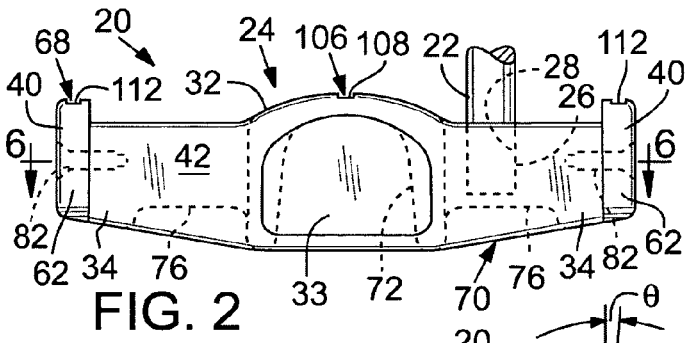
FIG. 2 is a front elevational view of the head the golf putter of FIG. 1, showing several features that allow customization of the weight and weight distribution of the putter head.
Figure 4:
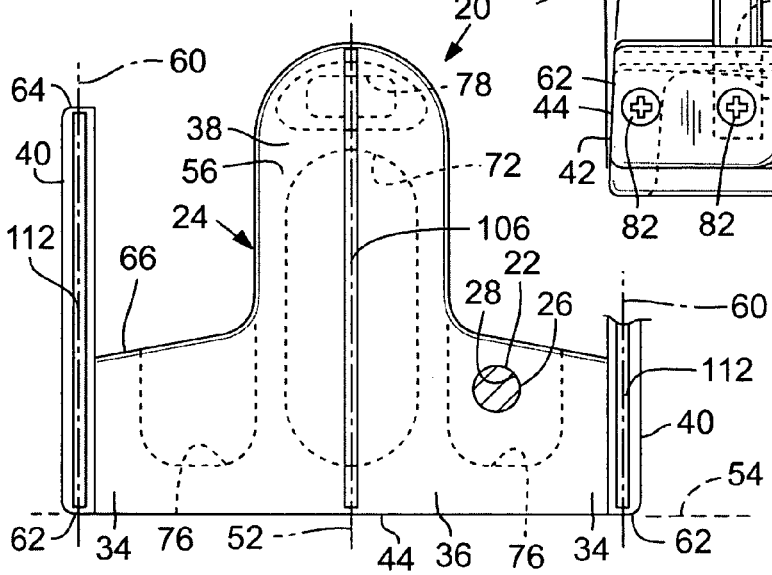
FIG. 4 is a top elevation view of the head of the golf putter of FIG. 1, showing several features that allow customization of the weight and weight distribution of the putter head and multiple sight lines on a top surface of the putter head.
Figure 5:
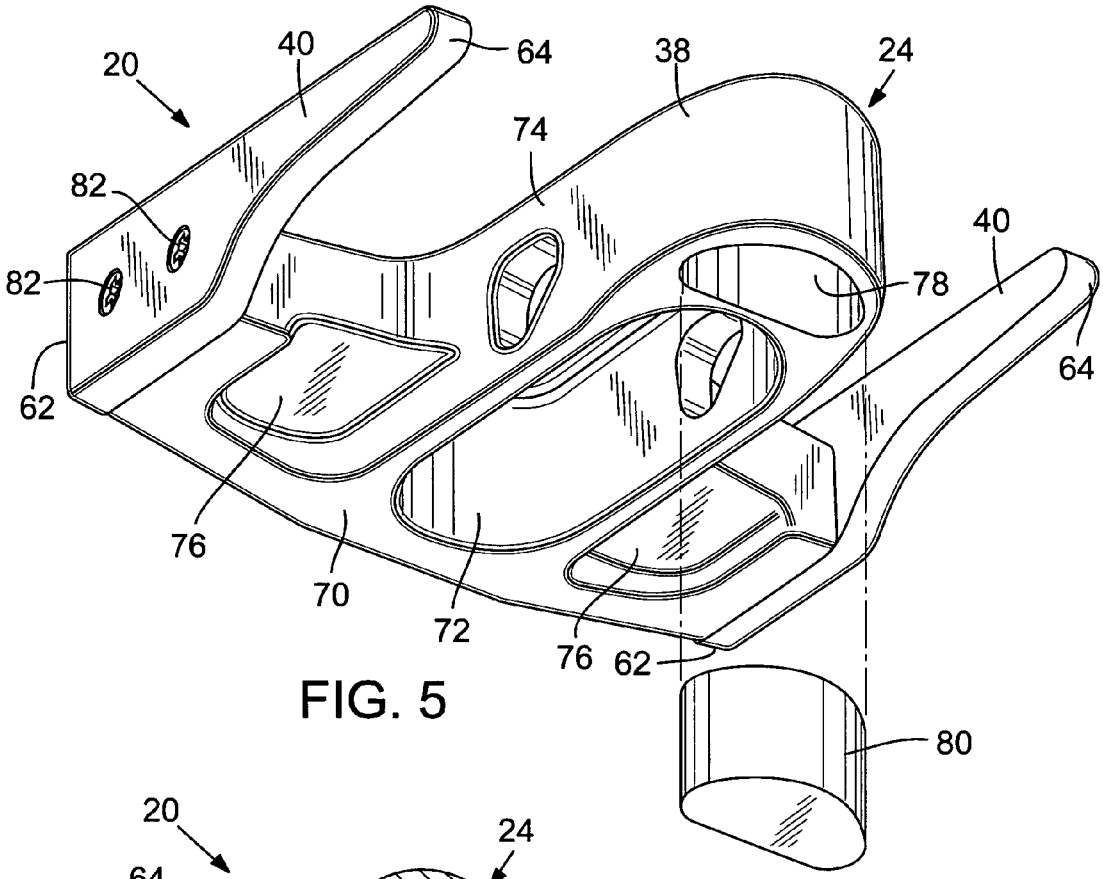
FIG. 5 is a partially exploded isometric view of the head of the golf putter of FIG. 1, viewed from the bottom, and showing several features that allow customization of the weight and weight distribution of the putter head.

Putting head 24 may include features that may allow a golfer or a manufacturer of putter 20 to modify the weight characteristics of putter head 24. As shown in FIGS. 2 and 4-6, a bottom surface 70 of putting head 24 may include a hollow space 72 formed in central member 38 that may also be open to the side surfaces 74 of central member 38. Similarly, as shown in FIGS. 2, and 4-5, putting head 24 may include at least one recess 76 on bottom side 70. Typically, head 24 includes one recess 76 disposed on body 36 on each side of central member 38. Hollow space 72 and recess 76 are normally formed in bottom surface 70 of putting head 24 in order to displace the center of mass of putting head 24 closer to top surface 32 than bottom surface 70.

Figure 6:
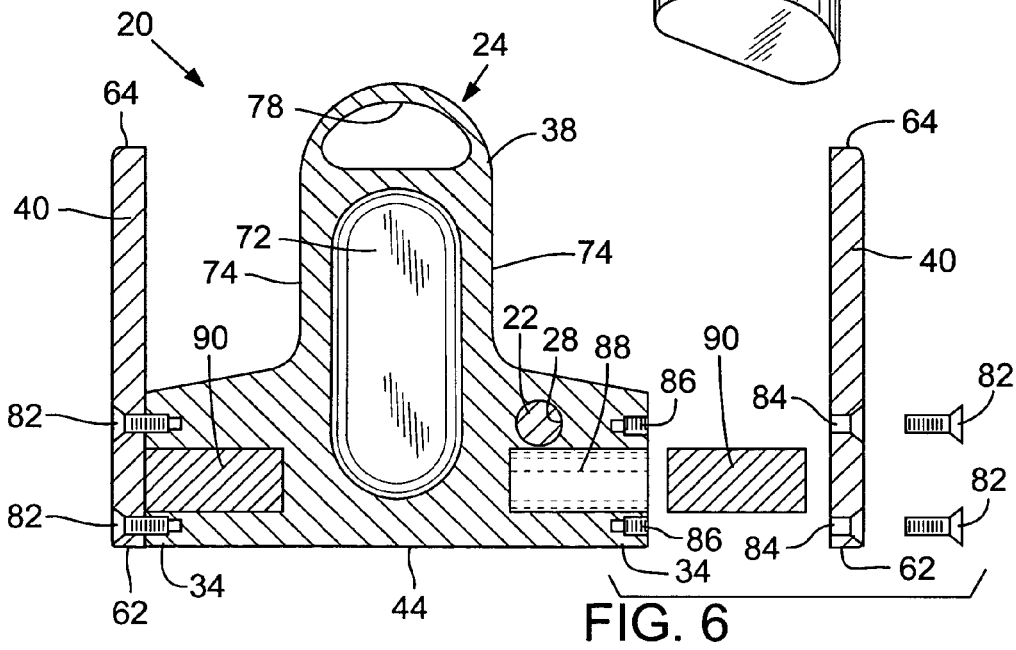
FIG. 6 is a partial exploded cross sectional view of the head the golf putter of FIG. 1, showing removable end members which reveal a cavity adapted for the installation of weights.

Putting head 24 may also include a weight cavity 78 formed in central member 38. Whereas FIGS. 4-6 show weight cavity 78 distal from the body and open to bottom surface 70, weight cavity 78 may be disposed at any position along central member 38. Weight cavity 78 typically is an opening that is adapted for the insertion of a weight, or slug, 80 that consists of a heavy material such as brass or iron. Together, weight cavity 78 and weight 80 may allow a golfer or a manufacturer of putter head 24 to configure both the location of the center of mass and the overall weight of putting head 24. Weight 80 is typically fixedly mounted within weight cavity 78, although it is within the scope of this disclosure to removably attach weight 80 with suitable fasteners such as screws and the like.

End members 40 may be formed integral with body 36. However, putter head 24 shown in FIGS. 1-6, normally includes end members 40 that are removably attached to ends 34 of body 36. At least one screw 82 may be threaded through a hole 84 in each end member 40 and into a threaded receiving portion 86 formed on ends 34 of body 36.

A golfer may modify the overall weight and the weight distribution of putter head 24 by installing end members 40 with varying overall weight and weight distribution. End members 40 may be fabricated from varying materials. End members 40 that are fabricated from light materials such as aluminum or titanium may give putter head 24 a more center-biased and lighter overall weight than may end members 40 that are fabricated from heavier materials such as copper, brass, or iron. These materials are provided for exemplary purposes, and are not intended to limit the scope of this disclosure.

FIGS. 2-4 and 6 show another way a golfer or a manufacturer of putter head 24 may modify the overall weight of putter head 24, and the distribution of that weight. The removal of end members 40 reveals an inner side cavity 88 in each end 34 that includes at least one opening that is adapted for the insertion of a weight or slug 90. Weights 90 may be fabricated of any suitable material. Insertion of a weight 90 fabricated from a heavy material such as copper, brass, or iron may increase the overall weight of putter head 24. A golfer may choose to insert weights 90 of different mass into each inner side cavity 88 in order to shift the center of mass of putter head 24 towards one end 34 or the other.

Figures 7, 8, 9, 10, 11:
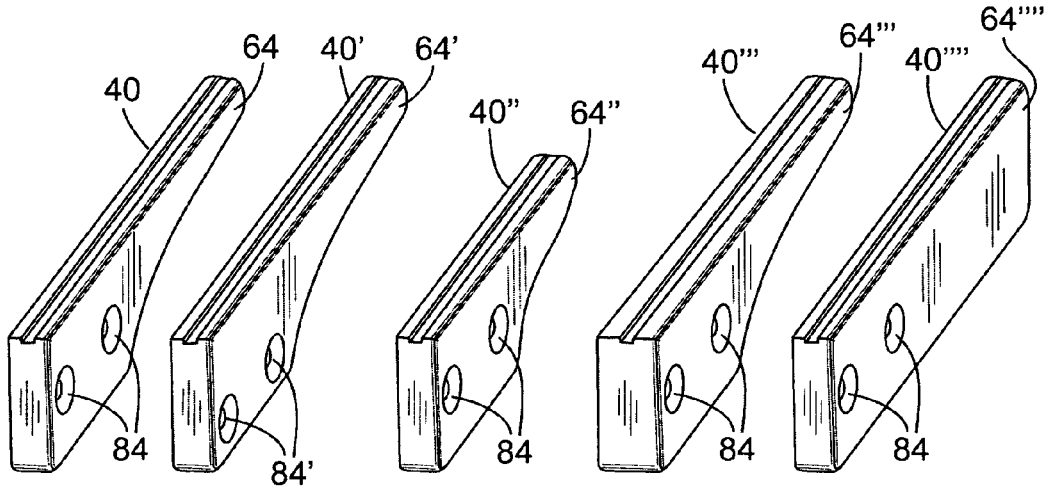
FIGS. 7-11 are isometric views of embodiments of end members suitable for use with the golf putter head of FIGS. 1-6.

FIGS. 7-11 show other manners in which the weight, as well as the weight profile, of end members 40 may be modified. FIGS. 7-11 are only exemplary manners in which the weight profile of end members 40 may be modified, and the scope of this disclosure is not limited to the end member profiles illustrated. FIG. 7 shows an end member 40 that is similar to the end members shown in FIGS. 1-6. FIG. 8 shows an end member 40' which is largely the same as end member 40, except that mounting holes 84' are displaced downwards, which may place the center of mass of a putter head 24 on which end member 40' may have been mounted closer to top surface 32 of putting head 24.

FIGS. 9-11 show other variations to end members 40. FIG. 9 shows an end member 40" that is shorter in length, and therefore lighter and more front-heavy, than end member 40. FIG. 10 shows an end member 40'" that is wider, and therefore heavier than end member 40. FIG. 11 shows an end member 40"" that has a squared-off rear portion 64"", rather than the tapered profile of end portion 40. End member 40"" will accordingly add more weight to a putter head 24, and distribute that weight closer to the rear. A golfer may choose to install one style of end member 40 on one end 34 of body 36, and a second style of end member 40 on the second end 34 of body 36 in order to shift the center of mass of putter head 24 towards one end 34 or the other.

Figure 12:
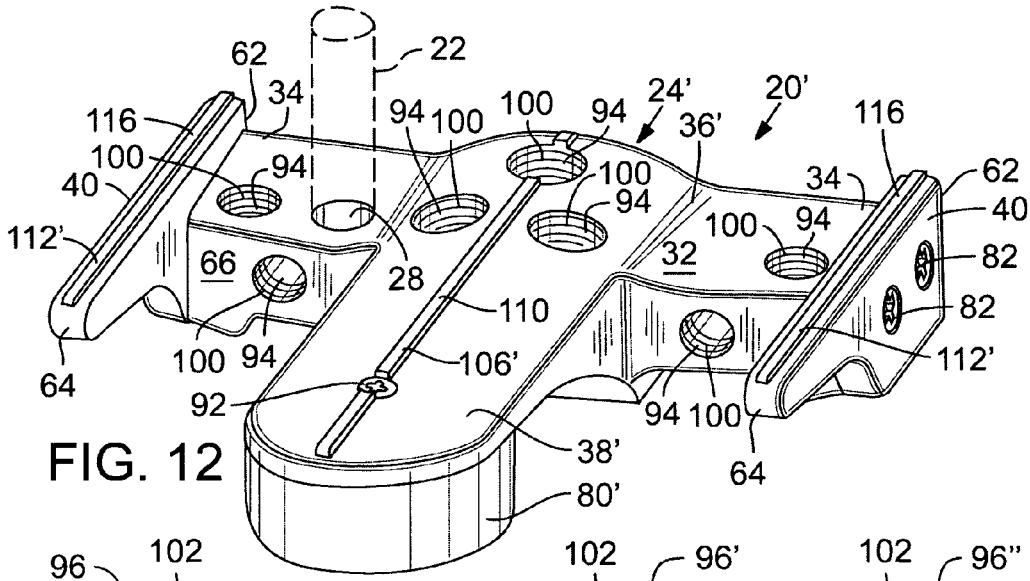
FIG. 12 is an isometric view of an embodiment of a golf putter according to the present disclosure, viewed from the top, showing several features that allow customization of the weight and weight distribution of the putter head.

FIG. 12 shows another embodiment of putter head 24'. Putter head 24' differs from the putter head 24 in several ways. Central member 38' has a tongue-like shape as it extends rearward from body 36' to provide a preferable weight profile with the center of mass closer to top surface 32. Analogous to internal weight 80 of putter head 24, a weight 80' may be mounted external to central member 38' of putter head 24'. Weight 80' may be permanently mounted by a manufacturer of putting head 24, or weight 80' may be removably attached to putter head 24' by a golfer who wishes to customize the weight of putter head 24'. Accordingly, screws 92, or similar means, may be provided to retain weight 80' on central member 38'

FIG. 12 shows yet another way a golfer or a manufacturer of putter head 24' may modify the overall weight of putter head 24', and the distribution of that weight. Putter head 24' may include any number of cavities 94 formed within body 36' or central member 38'. Cavities 94 may be adapted for the insertion of additional weights or slugs 96. Weights 96 may be either fixedly attached a manufacturer of putter head 24, or removably attached by a golfer who wishes to customize the weight and weight distribution of putter head 24'. Although FIG. 12 shows cavities 94 formed on a top surface 32 and rear surface 66 only, cavities 94 may be formed on any surface of putter head 24'.

Figure 13:
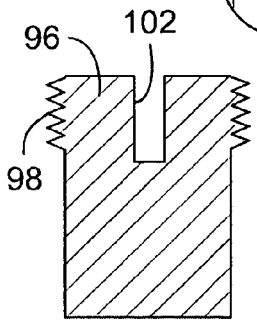
FIG. 13-15 are a cross-sectional views of embodiments of weights suitable for use with the golf putter of FIGS. 1-5 or 11.
Figure 14:
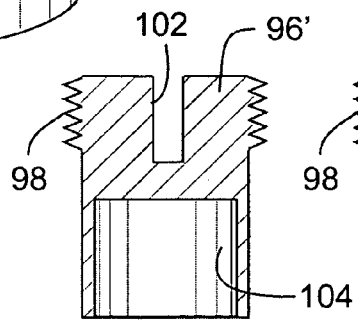
Figure 15:
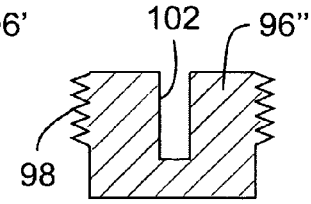

Like weights 80, 80', and 90, weights 96 may be fabricated from materials of varying weights which allow the golfer to configure putter head 24' with a range of overall weights and customize the distribution of that weight by selecting which cavity 94 will be filled with each type of weight. FIGS. 13-15 show several embodiments of weights 96 that may be suitable for insertion into cavity 94. Weight 96, 96' and 96" include threads 98 that may mate with complementary threads 100 on a lip of cavity 94 by turning a screwdriver or similar tool which has been inserted into slot 102 in order to retain the weight to putter head 24'. Weight 96' includes a hollowed end 104 that may reduce the overall mass of weight 96' from that of weight 96 without reducing its overall height. Weight 96" is generally shorter than either weight 96 or 96'. The scope of this disclosure is not limited to the shapes and mating technique set forth hereinabove for cavity 94 and weight 96.

Putting head 24 may further include features that may allow a golfer to more accurately aim a putt. Top surface 56 of central member 38 may include a central sight line marking 106 that marks central axis 52. Central sight line marking 106 typically ends on front face 42 at or near the midpoint 48 of ball striking area 33. Accordingly, central sight line marking 106 allows the golfer to aim his putts towards a golf hole. Central sight line marking 106 preferably includes a groove 108 that is recessed below top surface 56 of central member 38. Alternatively, central sight line marking 106 may include a ridge 110, like central sight line marking 106' of putter head 24' in FIG. 12, that is raised above top surface 56 of central member 38.

In addition to central sight line marking 106, putting head 24 may include end sight lines 112 that mark axes 60 of end members 40. End sight lines 112 are typically substantially parallel to central sight line marking 106, and may provide additional lines of reference for the golfer to aim a putt. Additionally, end sight lines 112 may be positioned vertically above central sight line marking 106, providing the golfer with a three-dimensional putting alignment tool. Normally, end sight lines 112 are approximately 4 ¼ inches apart, which corresponds to the diameter of a typical regulation sized golf hole. End sight line marking 112 may include a groove 114 that is recessed below top surface 68 of end member 40. Alternatively, end sight line marking 112 may include a ridge 116, like end sight line marking 112' of putter head 24' in FIG. 12, that is raised above top surface 68 of end member 40.

Whereas putter head 24 of FIG. 1 shows central sight line marking 106 and end sight line marking 112 all including recessed grooves, and putter head 24' of FIG. 12 shows central sight line marking 106' and end sight line marking 112' all including raised ridges, any combination of recessed grooves, raised ridges, or other sight line markings not pictured is within the scope of this disclosure.

Typically, central member 38 is formed integral with body 36 and may be fabricated by milling, casting, forging, or other suitable manufacturing process. Body 36 and central member 38 are normally fabricated form metallic materials such as aluminum or titanium, which are known to be suitable metals for these applications. Similarly, as discussed hereinabove, end members 40 may be fabricated from these metallic materials, or other suitable materials, and end members 40 are not restricted to be fabricated from the same material as body and central member 38.

Golf putter 20 may be a part of a golf putter system which may include putter 20, a variety of various end members 40 offering different weights and weight distributions, as well as a variety of weights 90 and 96. This golf putter system may allow a golfer, within an established set of rules of golf, to customize his putter to suit his particular style of play.

I claim:

1. A golf putter comprising:

an elongated shaft; and a head that is attached to the shaft, the head including:

an elongated body extending along a body axis and including a front face having a substantially flat putting surface substantially parallel to the body axis and adapted to strike a golf ball on a ball striking area disposed on the putting surface;

an elongated central member that extends rearward from the body in the proximity of the ball striking area, the central member having a central axis that is substantially perpendicular to a longitudinal axis of the putting face, the central member also having a width that is similar to the diameter of a golf ball;

two elongated end members removably mounted laterally to each end of the body, the end members having axes that are substantially perpendicular to the longitudinal axis of the putting face and a rear portion that extends beyond a rear surface of the body;

a central sight line that marks the central axis of the central member; and two end sight lines that mark the axes of the end member, the end sight lines being spaced apart by a width that is similar to the diameter of a golf hole.

2. The golf putter of claim 1, wherein the head further includes one or more cavities exposed by the removal of one or both of the elongated end members and adapted to receive one or more weights that allow a user to configure the location of the center of mass of the head and that allow a user to configure the overall weight of the head.

3. The golf putter of claim 1, wherein the end members are fabricated from a different material than the body.

4. The golf putter of claim 1, wherein the end members each include a substantially flat top surface that extends above a top surface of the body when the end member Is mounted to the body.

5. The golf putter of claim 1, wherein each end member is selected from a plurality of end members, each end member of the plurality being adapted, when removably mounted laterally to each end of the body, to provide the head with one of a different weight and a different weight distribution than any other end member in the plurality of end members.

6. A golf putter head comprising:

at least one opening that is adapted to receive an end of a shaft;

an elongated body extending along a body axis and including a front face having a substantially flat pulling surface substantially parallel to the body axis and adapted to strike a golf ball on a ball striking area disposed on the putting surface;

an elongated central member that extends rearward from the body in the proximity of the ball striking area, the central member having a central axis that is substantially perpendicular to a longitudinal axis of the putting face, the central member also having a width that is similar to the diameter of a golf ball;

two elongated end members that are removably mounted laterally to each end of the body, the end members having axes that are substantially perpendicular to the longitudinal axis of the pulling face and a rear portion that extends beyond a rear surface of the body;

a central sight line that marks the central axis of the central member; and two end sight lines that mark the axes of the end member, the end sight lines being spaced apart by a width that is similar to the diameter of a golf hole.

7. The golf putter head of claim 6, wherein the head further includes one or more cavities exposed by the removal of one or both of the elongated end members and adapted to receive one or more weights that allow a user to configure the location of the center of mass of the head and that allow a user to configure the overall weight of the head.

8. The golf putter head of claim 6, wherein the end members are fabricated from a different material than the body.

9. The golf putter head of claim 6, wherein the end members each include a substantially flat top surface that extends above a top surface of the body when the end member is mounted to the body.

10. The golf putter head of claim 6, wherein each end member is selected from a plurality of end members, each end member of the plurality being adapted, when removably mounted laterally to each end of the body, to provide the head with one of a different weight and a different weight distribution than any other end member in the plurality of end members.

11. A golf putter system comprising:

a shaft;

a head that is attached to an end of the shaft, the head extending along a body axis and including an elongated body including a front face having a substantially flat putting surface extending substantially parallel to the body axis and adapted to strike a golf ball on a ball striking area disposed on the putting surface; and a plurality of elongated end members that are releasably attachable laterally to each end of the body, the end members, when attached to the body, allowing a user to configure the overall weight of the head and allowing a user to configure the location of the center of mass of the head, the end members including:

a rear portion that, when attached, extends beyond a rear surface of the body, axes that are substantially perpendicular to a longitudinal axis of the putting face when attached, and end sight lines that mark the axes of the end members, the end sight lines being spaced apart by a width that is similar to the diameter of a golf hole when the end members are attached to the head.

12. The golf putter system of claim 11, wherein, when the putter is held in a putting position, the putting surface forms an angle between approximately 0 and 6 degrees with a substantially vertical plane.

13. The golf putter system of claim 11, wherein the ball striking area is disposed at a midpoint of the putting surface.

14. The golf putter system of claim 11, wherein the end sight line markings include ridges that are raised above the top surfaces of the end members.

15. The golf putter system of claim 11, wherein the end sight line markings include grooves that are recessed below the top surfaces of the end members.

16. The golf putter system of claim 11, wherein the head has a center of mass, and wherein the center of mass of the head is disposed behind the ball striking area.

17. The golf putter system of claim 11, wherein the center of mass of the head is disposed closer to a top surface of the head than to a bottom surface of the head.

18. The golf putter system of claim 11, wherein at least one end member is fabricated from a different material than the body.

19. The golf putter system of claim 11, wherein the end members include a substantially flat top surface that extends above a top surface of the body when the end member is attached to the body.

20. The golf putter system of claim 11, wherein the head further includes:

an elongated central member that extends rearward from the body in the proximity of the ball striking area, the central member having a central axis that is substantially perpendicular to a longitudinal axis of the putting face, the central member also having a width that is similar to the diameter of a golf ball;

a central sight line that marks the central axis of the central member; and one or more cavities adapted to releasably receive one or more weights that allow a user to configure the location of the center of mass of the head and that allow a user to configure the overall weight of the head;

wherein at least one cavity is exposed by the removal of one or more of the end members; and wherein the system further includes a plurality of weights adapted to be inserted in the at least one cavity and to be retained by the corresponding end member.

* * * * *